United States Patent [19]

Cendak

[11] 4,050,421

[45] Sept. 27, 1977

[54] CYLINDER LINER WITH INTERNAL COOLING DUCTS FOR INTERNAL COMBUSTION RECIPROCATING ENGINES

[75] Inventor: Bruno Cendak, Trieste, Italy

[73] Assignee: Grandi Motori Trieste S.p.A. G.M.T. - Fiat, Ansaldo, C.R.D.A., Trieste, Italy

[21] Appl. No.: 711,897

[22] Filed: Aug. 5, 1976

[30] Foreign Application Priority Data

Aug. 27, 1975 Italy ..... 69144/75

[51] Int. Cl.[2] ..... F02F 1/10

[52] U.S. Cl. ..... 123/41.72; 123/41.79; 123/41.81; 165/142

[58] Field of Search ..... 123/41.72, 41.81, 41.74, 123/41.79; 165/142

[56] References Cited

U.S. PATENT DOCUMENTS

| | | | |
|---|---|---|---|
| 1,177,162 | 3/1916 | Zona | 123/41.79 |
| 1,484,240 | 2/1924 | Still | 123/41.72 |
| 1,752,899 | 4/1930 | Edwards | 123/41.72 |
| 2,277,113 | 3/1942 | Kimmel | 123/41.72 |
| 2,665,556 | 1/1954 | Otten | 165/142 |
| 2,895,458 | 7/1959 | Jacklin | 123/41.72 |
| 3,157,921 | 11/1964 | Porter | 165/142 |
| 3,207,139 | 9/1965 | Brown | 123/41.72 |
| 3,745,980 | 7/1973 | Pekar, Jr. et al. | 123/41.72 |

*Primary Examiner*—Carroll B. Dority, Jr.
*Assistant Examiner*—Andrew M. Dolinar
*Attorney, Agent, or Firm*—Sughrue, Rothwell, Mion, Zinn and Macpeak

[57] ABSTRACT

A cylinder liner for a large size internal combustion engine has a neck which extends between the cylinder block and the head to define a combustion chamber in each cylinder. The liner has internal cooling ducts which are formed by blind holes in the neck of the liner which communicate with entry and exit passages for liquid coolant at parts of the liner within the cylinder block, leaving the exposed neck portion free of through holes where high strength is required. Each blind hole is subdivided by an internal baffle into flow and return passages for coolant.

4 Claims, 5 Drawing Figures

CYLINDER LINER WITH INTERNAL COOLING DUCTS FOR INTERNAL COMBUSTION RECIPROCATING ENGINES

BACKGROUND OF THE INVENTION

The present invention relates to internal combustion reciprocating engines, especially, but not exclusively, large size 2- and 4-stroke Diesel engines, and relates particularly to cylinder liners for such engines.

More specifically, the invention is concerned with cylinder liners of the type having a neck extending between the cylinder block and the cylinder head of the engine and a number of internal cooling ducts provided in the neck for the through flow of a cooling liquid which in use of the liner enters these ducts from an annular space surrounding the part of the cylinder liner located within the cylinder block and which emerges from the said ducts into a collection chamber which surrounds the neck and from which the cooling liquid is directed towards the cylinder head.

As known, the function of the cylinder liner is to delimit, together with the cylinder head and the crown of the associated piston, the combustion chamber of the cylinder. In this combustion chamber the material of the cylinder liner, and in particular that of its neck enclosed between the cylinder block and the cylinder head of the engine, must be resistant to the high stresses, both thermal and mechanical, resulting from the temperature and pressure of the combustion gases. The possibility of resisting such stresses is dependent, among other factors, upon the means used to limit the operating temperature of the internal wall of the cylinder liner.

The object of this invention is to provide a cylinder liner having an efficient cooling means without this causing any substantial reduction in the strength of the cylinder liner in the neck region enclosed in use of the liner between the cylinder heads and the cylinder block.

A known method of limiting the temperature of the internal wall of cylinder liners in engines, especially large size 2 and 4-stroke Diesel engines, is to provide intensive cooling by means of a series of through ducts, formed by drillings in the neck of the cylinder liner, which are either independent of each other or interconnected, so that the parts which suffer the most severe thermal stress can be traversed by a cooling liquid flowing through the ducts.

In a traditional cylinder liner with an internally cooled neck of the aforementioned type the coolant circulation ducts pass through the neck region of the liner disposed, in use of the liner, between the cylinder block and the cylinder head, thus constituting a dangerous weakness in a relatively highly stressed part of the liner.

The problem with which the present invention is concerned is that of providing a cylinder liner with internal cooling ducts in the region of its neck without substantially weakening the liner by the presence of these ducts.

SUMMARY OF THE INVENTION

According to the present invention there is provided a cylinder liner of the type hereinbefore defined, characterised in that each of the internal ducts of the liner is constituted by:

a blind hole communicating with the said annular space and extending towards the cylinder head;

a hole extending transversely with respect to the blind hole and communicating with the latter to provide communication between the blind hole and the collection chamber, the transverse hole being located adjacent the open end of the blind hole and debouching on the outside of the cylinder liner in a region different from that of the neck, and a baffle extending longitudinally within the blind hole and subdividing it into a flow passage extending from the end of the blind hole which communicates with the annular space up to a point adjacent the blind end of the blind hole, and into a return passage extending from said point adjacent to the blind end, at which it communicates with said flow passage, to the associated transverse hole which communicates with the collection chamber.

The cooling ducts in the cylinder liner according to the invention provide a circuit for the circulation of the cooling liquid without using through holes, thus avoiding weakening of the cylinder liner by through holes traversing regions where it is desirable that the liner should have high strength to resist mechanical stresses.

BRIEF DESCRIPTION OF THE DRAWINGS

The invention will be further described, by way of non-limiting example, with reference to the appended drawings, in which.

DETAILED DESCRIPTION OF THE ILLUSTRATED EMBODIMENT

Figure 1:
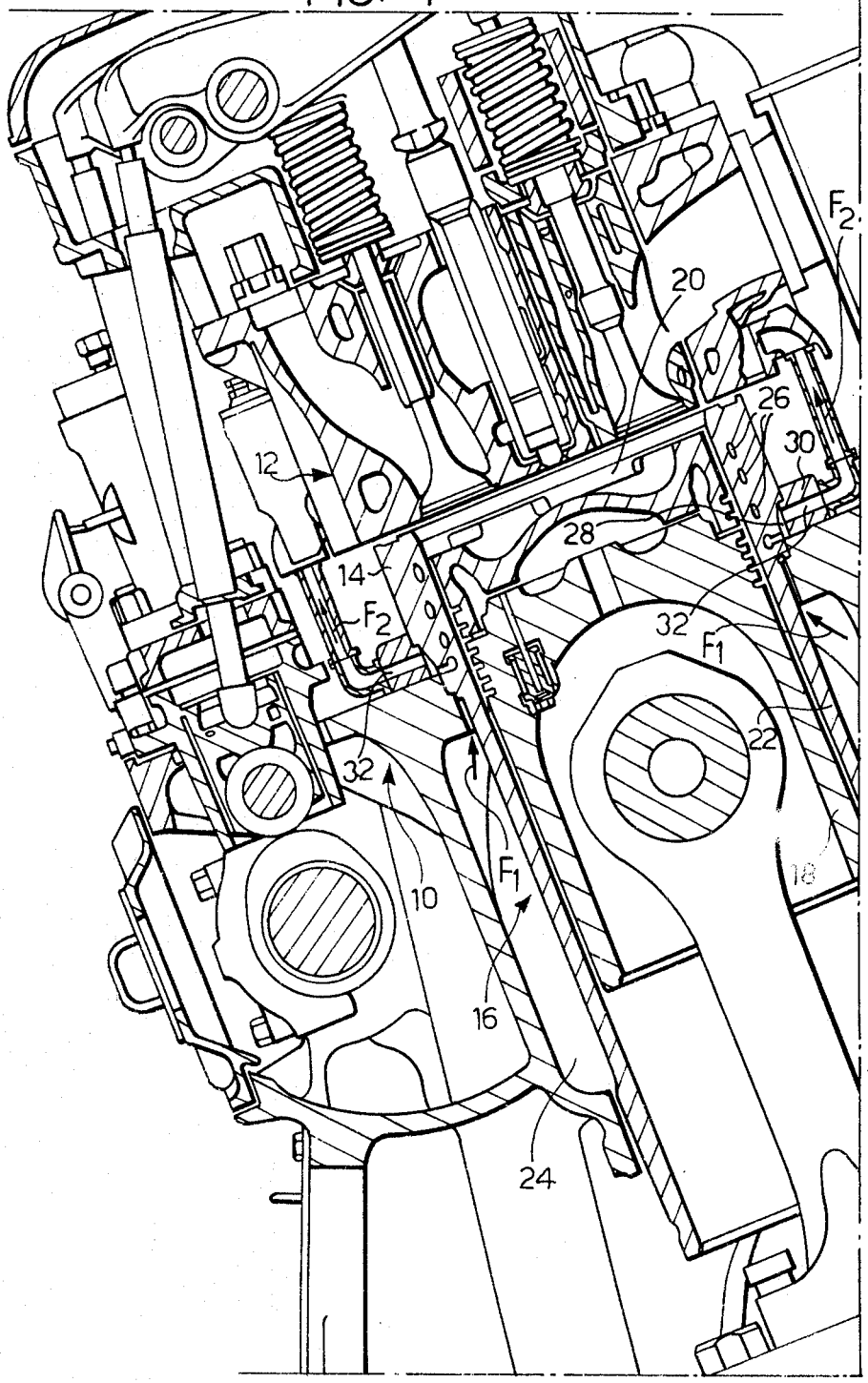
FIG. 1 is a transverse cross section of part of an internal combustion engine, carried out in a plane containing the axis of a cylinder provided with a cylinder liner according to a preferred embodiment of the invention.
Figure 2:
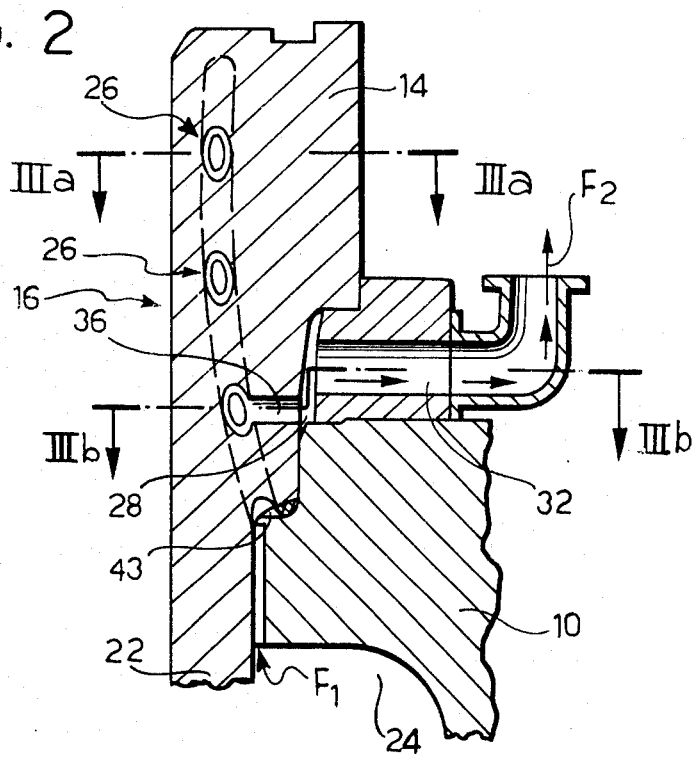
FIG. 2 is an enlarged partial section of part of the cylinder liner shown in FIG. 1.

With reference to FIGS. 1 and 2, between the cylinder block 10 and the cylinder head 12 of a reciprocating internal combustion engine a neck 14 of a cylinder liner 16 is enclosed. A piston 18 slides within the liner 16 and the crown of the piston defines with the cylinder head 12 and the neck 14 a combustion chamber 20.

The part 22 of the cylinder liner 16 which is located within the cylinder block 10 is surrounded by an annular space 24 from which, in use of the engine, a cooling liquid passes, in a path indicated by arrows $F_1$, into a series of internal cooling ducts 26 provided in the neck 14 of the liner. The manner in which these ducts 26 are formed is described hereinafter. After having traversed the ducts 26, the cooling liquid flows out into an annular collection chamber 28 which surrounds the neck 14 between the cylinder block 10 and the cylinder head 12. This collection chamber 28 is delimited externally by a spacing ring 30 which has radial passages 32 through which the cooling liquid passes, flowing thence into the cylinder head 12 along a path indicated by the arrows $F_2$. The neck 14 is enclosed between the cylinder head 12 and the spacing ring 30.

Figure 4:
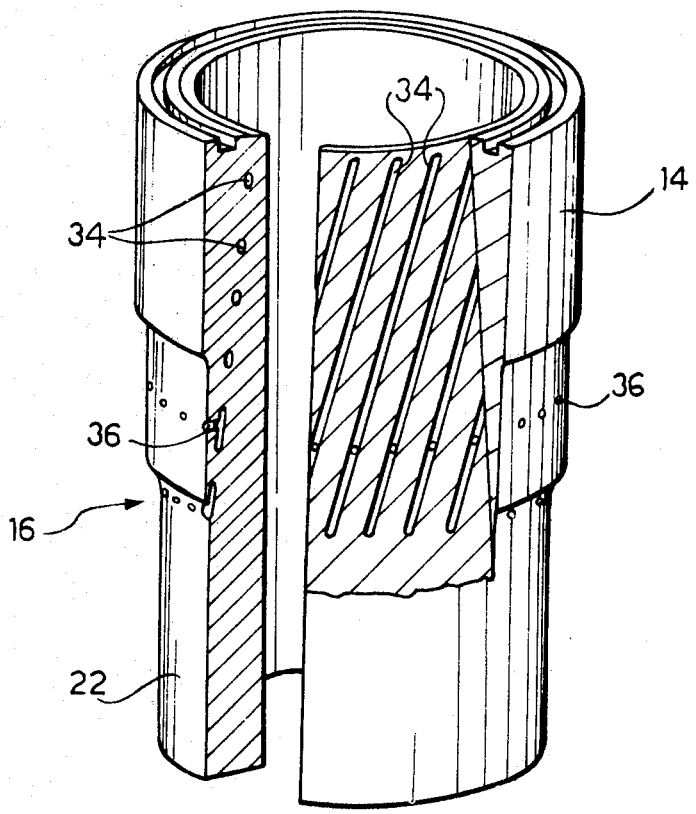
FIG. 4 is a partly cut away perspective view of the cylinder liner, in which the internal ducts have been shown without their internal baffles.

With reference to FIGS. 2 to 5 a description will be given of the manner in which the internal ducts 26 are formed. Each of the ducts 26 includes a blind hole 34 extending from a region 43 (FIG. 2) communicating with the space 24 towards the cylinder head 12, preferably obliquely, as shown in FIG. 4, with respect to the axis of the cylinder liner 16. Furthermore, each duct 26 further includes a hole 36 extending transversely with respect to the blind hole 34 and communicating with the latter and with the collection chamber 28. In view of the position of the collection chamber 28, the transverse hole 36 is situated adjacent the open end of the blind hole 34. Because the neck 14 is enclosed between the cylinder head 12 and the spacing ring 30, the hole 36 is disposed in a region of the cylinder liner 16 which is not highly stressed at the operating pressure of the engine.

Figure 5:
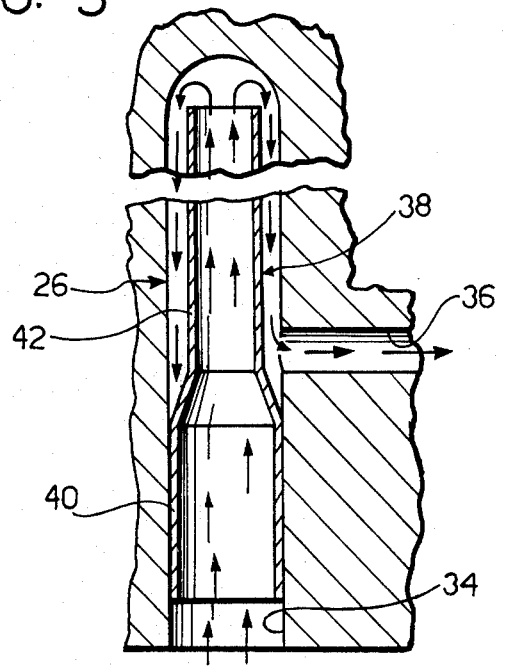
FIG. 5 is a much enlarged section of part of the liner taken along a surface containing the axis of one of the blind holes and the axis of a transverse hole communicating with the blind hole.
Figure 3:
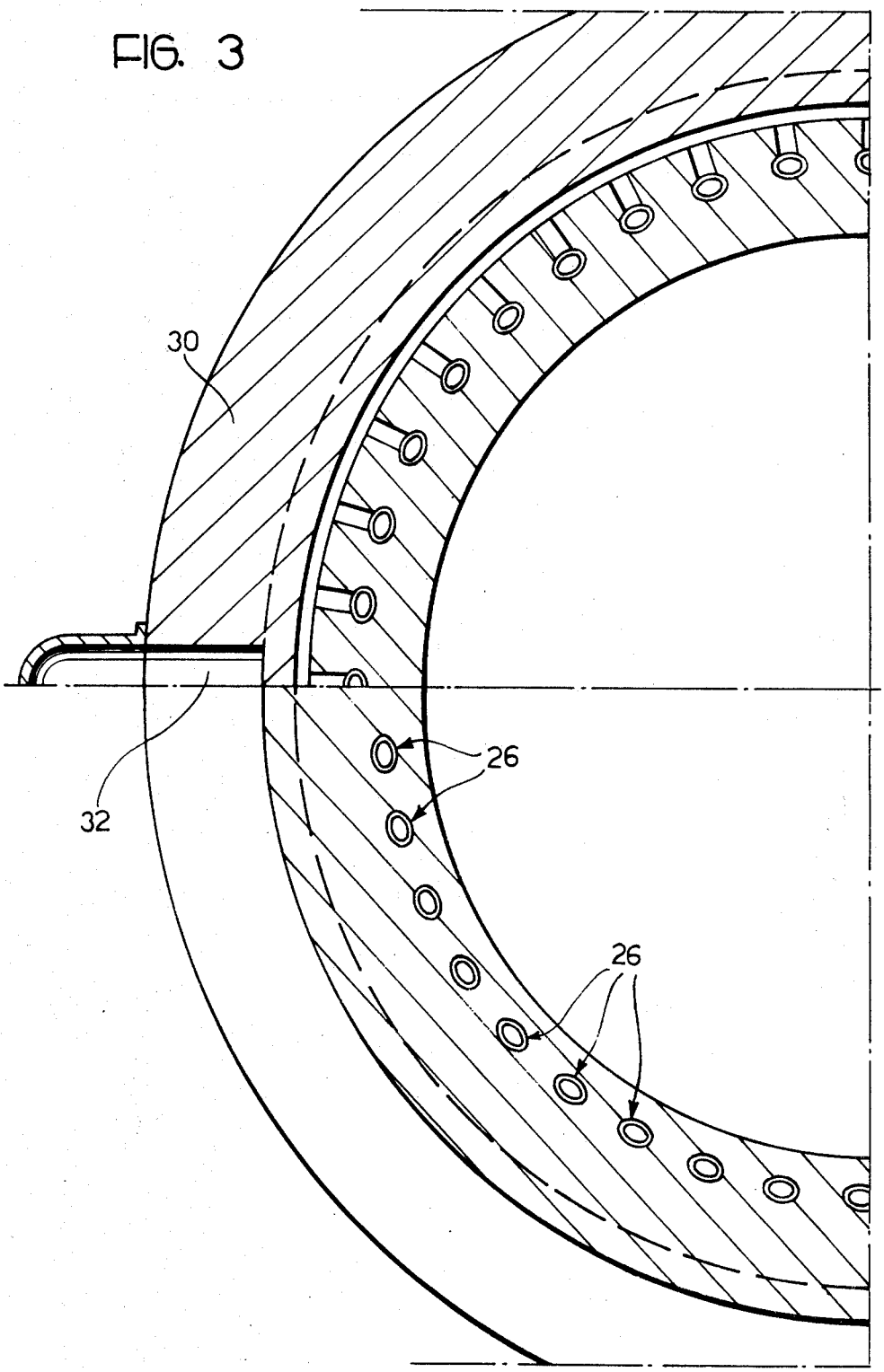
FIG. 3 is a partial transverse cross section of the cylinder liner taken, in the lower part of FIG. 3, along the line III*a*—III*a* of FIG. 2, and in the upper part of FIG. 3, along the line III*b*—III*b* of FIG. 2.

As can be seen more clearly from FIG. 5, inside each of the blind holes 34 there is inserted a baffle 38, preferably of tubular form as shown, which extends in the longitudinal direction of the hole 34 in such a manner as to subdivide the hole 34 into a flow passage extending from the end of the hole 34 communicating with the space 16 up to a point adjacent the opposite blind end of the hole, and into a return passage extending from the said point adjacent the said blind end, at which it communicates with the flow passage, to the respective transverse hole 36 communicating with the collection chamber 28. The tubular baffle 38 has a first portion 40 the cross section of which corresponds to that of the blind hole 34 so as to be a sealing fit therein. This portion 40 extends in the hole 34 from its end communicating with the space 24 up to a point in the vicinity of and not beyond the transverse hole 36. The tubular baffle 38 also has a second portion 42 of a diameter smaller than that of the blind hole 34 which extends within the hole 34 towards its blind end as a continuation of the first portion 40, the baffle 38 terminating short of the blind end of the hole 34. The path of the cooling liquid in the duct 26 is indicated by means of arrows in FIG. 5.

What is claimed is:

1. A cylinder liner for internal combustion reciprocating engines, of the type having a neck which in use of the liner extends between a cylinder block and a cylinder head of the engine and means defining a number of internal cooling ducts in the neck for the through flow of a cooling liquid which in use of the liner enters these ducts from a means forming an annular space surrounding the part of the cylinder liner located within the cylinder block and which emerges from the said ducts into a means forming a collection chamber which surrounds the neck and from which the cooling liquid is directed towards the cylinder head, wherein the improvement consists in the means defining each of the internal ducts in the liner comprising:

means defining a blind hole communicating with the said part of the liner and extending towards the cylinder head;

means defining a hole extending transversely with respect to the blind hole and communicating with the latter to provide communication between the blind hole and the collection chamber, the transverse hole being located adjacent the open end of the blind hole and debouching on the outside of the cylinder liner in a region different from that of the neck, and baffle means extending longitudinally within the blind hole and subdividing it into a flow passage extending from the end of the blind hole which communicates with the annular space up to a point adjacent the blind end of the blind hole, and into a return passage extending from said point adjacent the blind end, at which it communicates with said flow passage, to the associated transverse hole which communicates with the collection chamber.

2. The cylinder liner defined in claim 1, wherein the baffle means inserted in the blind hole of each of the internal ducts comprises a tubular baffle having a first portion the cross section of which corresponds to that of the blind hole, the first portion extending within the blind hole from the end of the latter communicating with the annular space to a point situated adjacent and not beyond the associated transverse hole, and a second portion of smaller cross section than the blind hole extending within the latter as a continuation of the first portion towards the blind end of the blind hole.

3. The cylinder liner defined in claim 1, wherein the blind holes extend obliquely with respect to the axis of the cylinder liner.

4. An internal combustion reciprocating engine having a cylinder block formed with cylinders, a cylinder head mounted on said cylinder block, cylinder liners within said cylinders, means in the cylinder block defining annular spaces surrounding the parts of the cylinder liner located within the cylinder block, each cylinder liner having a neck which extends between the cylinder block and the cylinder head to delimit a respective combustion chamber in the cylinder, means defining a collection chamber surrounding said neck, and means defining internal cooling ducts in said neck for the through flow of a cooling liquid which in use of the engine enters the ducts from said annular space and leaves the ducts to enter said collection chamber, wherein the improvement consists in the means defining each of the internal ducts in each liner comprising:

means defining a blind hole communicating with the said part of the liner and extending towards the cylinder head;

means defining a hole extending transversely with respect to the blind hole and communicating with the latter to provide communication between the blind hole and the collection chamber, the transverse hole being located adjacent the open end of the blind hole and debouching on the outside of the cylinder liner in a region different from that of the neck, and baffle means extending longitudinally within the blind hole and subdividing it into a flow passage extending from the end of the blind hole which communicates with the annular space up to a point adjacent the blind end of the blind hole, and into a return passage extending from said point adjacent the blind end, at which it communicates with said flow passage, to the associated transverse hole which communicates with the collection chamber.

* * * * *